US007422629B1

(12) United States Patent
Kawaguchi et al.

(10) Patent No.: US 7,422,629 B1
(45) Date of Patent: Sep. 9, 2008

(54) NONSLUDGING ZINC PHOSPHATING COMPOSITION AND PROCESS

(75) Inventors: Jun Kawaguchi, Yokohama (JP); Kazuhiro Ishikura, Aichi (JP); Tomoyuki Manmi, Chigasaki (JP)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 0 days.

(21) Appl. No.: 09/914,701

(22) PCT Filed: Mar. 2, 2000

(86) PCT No.: PCT/US00/05458

§ 371 (c)(1),
(2), (4) Date: Aug. 31, 2001

(87) PCT Pub. No.: WO00/52227

PCT Pub. Date: Sep. 8, 2001

(30) Foreign Application Priority Data

Mar. 2, 1999 (JP) ..... 11-54834

(51) Int. Cl.

| | |
|---|---|
| ***C25D 9/04*** | (2006.01) |
| ***C23C 22/07*** | (2006.01) |
| ***C23C 22/12*** | (2006.01) |
| ***C23C 22/13*** | (2006.01) |
| *C25D 9/10* | (2006.01) |
| *C23C 22/06* | (2006.01) |

(52) U.S. Cl. ..... 106/14.12; 106/14.05; 106/14.21; 148/253; 148/256; 148/275; 205/80; 205/124; 205/197; 205/217; 205/219; 205/318; 205/320; 205/323

(58) Field of Classification Search ..... 148/262, 148/241, 254, 244, 253, 256, 275; 205/111, 205/318, 189, 320, 80, 124, 197, 217, 219, 205/323; 106/14.21, 14.05, 14.12
See application file for complete search history.

(56) References Cited

U.S. PATENT DOCUMENTS

| | | | | | |
|---|---|---|---|---|---|
| 3,449,222 | A | | 6/1969 | Freeman et al. | |
| 3,449,229 | A | | 6/1969 | Freeman et al. | |
| 3,619,300 | A | * | 11/1971 | Heller et al. | 148/262 |
| 3,647,568 | A | | 3/1972 | Larson | 148/6.15 Z |
| 4,517,030 | A | * | 5/1985 | Yamamoto et al. | 148/254 |
| 4,639,295 | A | | 1/1987 | Miyamoto et al. | |
| 4,861,441 | A | * | 8/1989 | Saito et al. | 205/244 |
| 4,874,480 | A | * | 10/1989 | Sonoda et al. | 205/212 |
| 4,950,339 | A | | 8/1990 | Gehmecker et al. | 148/262 |
| 5,152,849 | A | * | 10/1992 | Bittner et al. | 148/262 |
| 5,203,930 | A | | 4/1993 | Bluemlhuber et al. | 148/262 |
| 5,348,640 | A | | 9/1994 | Shimakura et al. | |
| 5,401,381 | A | | 3/1995 | Seidel et al. | 205/177 |
| 5,503,733 | A | * | 4/1996 | Speckmann et al. | 205/318 |
| 5,525,431 | A | | 6/1996 | Kanamaru et al. | 428/623 |
| 5,645,706 | A | * | 7/1997 | Matsuda | 205/82 |
| 6,235,180 | B1 | * | 5/2001 | Kobayashi et al. | 205/141 |

FOREIGN PATENT DOCUMENTS

| | | | |
|---|---|---|---|
| JP | 62-050496 | * | 3/1987 |
| WO | WO91/19836 | | 12/1991 |
| WO | WO 98/09006 | * | 3/1998 |
| WO | WO 98/09006 | A1 | 3/1998 |
| WO | 00/15879 | A1 | 3/2000 |

OTHER PUBLICATIONS

JP 64-21095—Jan. 24, 1989—Questel Orbit Accession No.: 1989-067014[09]; Sec. Acc. No. CPI: C1989-029997; Derwent Manual code: CPI: M11-F; Derwent Classes: M14.
JP 4-36498(WO9119836)—Feb. 6, 1992—Questel Orbit Accession No. 1992-024448[03]; Sec. Acc. No. CPI: C1992-010622; Derwent Manual code: CPI: M14-D02; Derwent Classes: M11.
JP 6-506263(DE4111186)—Jul. 14, 1994—Questel Orbit Accession No. 1992-341224[42]; Sec. Acc. No. CPI: C1992-151712; Derwent Manual code: CPI: M14-D02; Derwent Classes: M14 (corresp. to US 5,401,381).

* cited by examiner

*Primary Examiner*—Lois Zheng
*Assistant Examiner*—Lois L Zheng
(74) *Attorney, Agent, or Firm*—Woodcock Washburn LLP

(57) ABSTRACT

Electrolysis using a suitable electrolyte provides a completely nonsludging zinc phosphate conversion coating process that produces a high quality conversion coating in a very short time. The suitable electrolyte contains at least water, dissolved nitric acid, and dissolved zinc cations and optionally also contains m chemically distinct species of cations other than zinc and n chemically distinct species of anions other than anions derivable by ionization of phosphoric and nitric acids, each of m and n independently being zero or a positive integer. Preferably, the liquid composition contains as additive at least one selection from nitrous acid, permanganic acid, peroxysulfuric acid, hydrogen peroxide, chloric acid, perchloric acid, nitrobenzenesulfonic acid, hydroxylamine, starch/phosphoric acid esters, fluorine compounds, and salts of the preceding; and/or the metal substrate is subjected to cathodic electrolysis after the workpiece has been brought into contact with a weakly basic aqueous colloidal solution that contains titanium oxide, titanium hydroxide, and zinc phosphate.

19 Claims, No Drawings

NONSLUDGING ZINC PHOSPHATING COMPOSITION AND PROCESS

This application claims priority from Japanese application H11-54834, filed Mar. 2, 1999, and International application PCT/US00/05458 (published in English), filed Mar. 2, 2000.

FIELD OF THE INVENTION

This invention relates to a nonsludging zinc phosphate treatment liquid composition, often hereinafter called a "bath" without thereby intending any implication that it must contact the surface to be phosphated by immersion, and a treatment process that employs this bath. This bath and treatment process are used for the formation of zinc phosphate coatings on metal surfaces.

BACKGROUND OF THE INVENTION

Phosphate treatments are widely used in general as a temporary anticorrosion treatment for iron and steel, as a paint undercoating treatment for iron and steel (including zinc-plated iron and steel) and aluminum, as a lubricant undercoating treatment in the plastic working of iron and steel, and as a lubrication treatment for sliding parts. Phosphate treatments are used for these applications because phosphate coatings, which function as passivating coatings, have the ability to impart corrosion resistance to metals and because these coatings have an excellent affinity for organic chemical substances (e.g., resins and oils) and as a result support and enable excellent adherence between organic chemical substances and metal surfaces. In other words, phosphate coatings have the most essential properties required of a surface treatment coating: corrosion resistance and adherence.

Phosphate coatings occur in a variety of types, such as iron phosphate, zinc phosphate, zinc iron phosphate, zinc calcium phosphate, and manganese phosphate, as a function of the nature of the particular metal workpiece. While each of these coating types is used as appropriate based on its specific properties, the highest demand is for the formation of zinc phosphate coatings and zinc iron phosphate coatings on iron and steel, including zinc-plated iron and steel (composite coatings of zinc phosphate and zinc iron phosphate are usually formed on iron and steel surfaces).

The phosphate treatment baths used with iron and steel take the form of acidic aqueous solutions made up from phosphoric acid, nitric acid, and zinc as essential components along with various additives. A conversion coating is formed when, for example, iron or steel is brought into contact with such a bath for several minutes. Some of the elementary chemical reactions that are believed to occur during such contact can be exemplified by the following chemical reaction (or half reaction) equations (1) through (5):

$$Fe-Fe^{2+}2e^{-} \quad (1)$$

$$2H^{+}+2e^{-}-H_2 \quad (2)$$

$$3Zn^{2+}+6H_2PO_4^{-}-Zn_3(PO_4)_2.4H_2O+4H_3PO_4 \quad (3)$$

$$2Zn^{2+}+Fe^{2+}+6H_2PO_4^{-}-Zn_2Fe(PO_4)_2.4H_2O+4H_3PO_4 \quad (3')$$

$$Fe^{2+}-Fe^{3+}+e^{-} \quad (4)$$

$$Fe^{3+}+H_2PO_4^{-}-FePO_4+2H^{+}. \quad (5)$$

Iron and steel dissolve according to equation (1) in acidic treatment baths such as phosphate treatment baths, and the electrons given up at this point are consumed in the discharge of hydrogen ions as in equation (2), causing an increase in pH at the metal surface. This increase in pH results in a shift in the degree of dissociation at equilibrium of the phosphoric acid, resulting in the insolubilization of a portion of the ferrous ions dissolved from the substrate and/or the zinc ions present in the phosphate treatment bath and formation of a coating of zinc phosphate and/or zinc iron phosphate on the substrate surface according to equation (3) and/or (3').

While the primary driving force for these coating-forming reactions is dissolution of the substrate according to equation (1), a large fraction of the dissolving ferrous ions ends up unused by the reactions. These "waste" ferrous ions must be removed from the <system, since they hinder diffusion of the zinc and phosphate ions and thereby lower the coating-forming reaction rate. In general, the ferrous ions are oxidized to ferric ions according to equation (4) by an oxidizer additive such as nitrite ions and precipitate as insoluble iron phosphate according to equation (5).

The ability of this chemical reaction system to eliminate the evolved impurities from the system as a solid precipitate enables use of the treatment bath on a semi-permanent basis simply by replenishing the consumed components—a feature that has contributed greatly to the industrial and commercial success of phosphate treatments. This notwithstanding, removal of this hydrous solid (sludge) requires complex management sequences, while the cost of treating the discharged sludge, which is an industrial waste, has been increasing. These factors have recently led to stronger demand specifically for a nonsludging phosphate treatment.

The execution of phosphate treatment using cathodic electrolysis is one counter-measure to the sludge problem. Cathodic electrolysis differs from the above-described conversion-based phosphate treatment in that reaction (2) is driven in cathodic electrolysis directly by electrical energy from an outside power source. The substrate dissolution reaction (1) is no longer necessary and the production of iron phosphate sludge can be avoided. However, since sludge actually also contains about 10 to 25% zinc phosphate in addition to iron phosphate, the use of just cathodic electrolysis cannot completely eliminate sludge production.

A number of processes for carrying out phosphate treatment by cathodic electrolysis have in fact already been disclosed in the prior art, most prominently in Japanese Laid Open (Kokai or Unexamined) Patent Application Numbers Sho 64-21095 (21,095/1989) and Hei 4-36498 (36,498/1992) and Japanese Laid Open Patent Application (PCT) Number Hei 6-506263 (506,263/1994). The object of Japanese Laid Open (Kokai or Unexamined) Patent Application Number Sho 64-21095 is high corrosion resistance and high adherence in application as a paint undercoating. This process cannot avoid sludge production, however, because trivalent iron cations are present in its treatment bath. Japanese Laid Open (Kokai or Unexamined) Patent Application Number Hei 4-36498 employs a high zinc-to-phosphoric acid ratio, probably because its object is the rapid formation of a fine and dense zinc phosphate coating. It is believed that a zinc phosphate sludge will be produced under these conditions. Japanese Laid Open Patent Application (PCT) Number Hei 6-506263, being concerned with countermeasures to the expense and toxicity of the nickel and/or cobalt sometimes deemed essential to the maximal performance of phosphate coatings as paint undercoatings, states that the concentration of these species in the treatment bath can be reduced through the use of electrolysis. Thus, no distinctive features can be discerned when the treatment bath compositions used in conversion processes are compared with these teachings; rather fine-sizing and densification (high corrosion resistance) of the coating or rapid coating formation is identified in each case as the advantage to the use of electrolysis and these teachings are silent on the subject of reducing sludge production.

The prior phosphate treatment technology as described above is thus unable to entirely eliminate sludge production. It is therefore an object of this invention to introduce a zinc phosphate treatment bath that is entirely free of sludge production. Another object of this invention is to introduce a zinc phosphate treatment process that uses said nonsludging zinc phosphate treatment bath.

SUMMARY OF THE INVENTION

It has been found that a nonsludging zinc phosphate treatment process can be obtained by electrolytically forming the zinc phosphate coating, using as electrolyte bath for the electrolysis reaction an aqueous solution that contains at least phosphoric acid, nitric acid, and zinc cations and may optionally contain m chemically distinct species of cations other than zinc and n chemically distinct species of anions other than anions derivable by ionization of phosphoric and nitric acids, each of m and n independently being zero or a positive integer, when in this bath the concentration of zinc in moles per liter (a concentration unit hereinafter usually either abbreviated as "mol/L" or by putting a chemical formula describing the molecular weight of a substance inside a pair of curly brackets) satisfies mathematical condition (6) as follows:

$$\{Zn\} \leq 0.3\{H_3PO_4\} + 0.5\{HNO_3\} - 0.5\sum_{i=0}^{m} p_i C_i + 0.5\sum_{j=0}^{n} q_j A_j \quad (6)$$

in which: "$\{Zn\}$", "$\{H_3PO_4\}$", and "$\{HNO_3\}$" respectively represent the zinc, phosphoric acid, and nitric acid concentrations in mol/L; each of $C_0$ and $A_0$ is zero; each of $p_0$ and $q_0$ is 1; if m is not zero, for each positive integer i from 1 to m, $C_i$ represents the concentration in mol/L of the i'th distinct cation species other than zinc present in the bath and $p_i$ represents the cationic valence of said i'th distinct cation species; and if n is not zero, for each positive integer j from 1 to n, $A_1$ represents the concentration in mol/L of the j'th distinct anion species other than anions derivable by ionization of phosphoric or nitric acids present in the bath and $q_j$ represents the anionic valence of said j'th distinct anion species.

DETAILED DESCRIPTION OF THE INVENTION AND PREFERRED EMBODIMENTS

The zinc phosphate treatment bath of this invention preferably also contains as additive at least one selection from nitrous acid, permanganic acid, persulfuric acid, hydrogen peroxide, chloric acid, perchloric acid, nitrobenzenesulfonic acid, hydroxylamine, starch/phosphoric acid esters, fluorine compounds, and salts of the preceding.

The nonsludging zinc phosphate treatment process of this invention characteristically comprises cathodic electrolysis treatment of a metal workpiece in a zinc phosphate treatment bath according to this invention as described above.

In the execution of the nonsludging zinc phosphate treatment process of this invention, the metal workpiece is preferably brought into contact—prior to the aforesaid cathodic electrolysis treatment—with a weakly basic aqueous colloidal solution that contains titanium oxide, titanium hydroxide, and zinc phosphate.

While mathematical condition (6) does limit the relationship between the zinc concentration and the phosphoric acid and nitric acid concentrations, it does not specify an absolute value for any of these concentrations. The observance of mathematical condition (6) is sufficient by itself for the specific purpose of avoiding sludge production. However, in order to facilitate the production of desired coating weights at industrially practical coating-formation rates in a zinc phosphating process according to this invention, the following preferences apply, each independently of the others:

- the phosphoric acid concentration preferably is at least, with increasing preference in the order given, 0.10, 0.20, 0.25, 0.30, or 0.35 mol/L;
- the nitric acid concentration preferably is at least, with increasing preference in the order given, 0.10, 0.20, 0.30, 0.40, 0.50, 0.60, 0.65, 0.70, or 0.75 mol/L; and
- the zinc concentration preferably is at least, with increasing preference in the order given, 50, 60, 70, 75, 80, 85, 90, 93, or 96% of the upper limit concentration calculated according to mathematical condition (6).

While the upper limits on the phosphoric acid and nitric acid concentrations is not critical, no improvement in the coating-forming activity has been found to occur at a phosphoric acid concentration in excess of 0.6 mol/L or a nitric acid concentration in excess of 1.0 mol/L, possibly because of a considerable increase in viscosity of the treatment bath when it contains such high concentrations of acid(s). This makes such concentrations economically undesirable. Furthermore, when in the industrial execution of this invention the absolute value of the phosphoric acid or nitric acid concentration is particularly high and the treatment bath is not adequately stirred, sludge may attach to pipe-work or other conduits that are in contact with the treatment solution on their external surfaces and have a hot fluid circulating through their interior to assist in maintaining the bath at a preferred temperature during its use. This localized sludge formation is believed to be due to local overheating. In order to avoid localized sludge formation and inconveniently high viscosity and to reduce the cost:benefit ratio of a process according to the invention, the following preferences apply, each independently of any other preferences:

- the concentrations of zinc and phosphate are such that $\{Zn\}/\{H_3PO_4\}<0.91$;
- the concentration of nitric acid is not more than, with increasing preference in the order given, 1.10, 1.00, 0.95, 0.90, or 0.85 mol/L; and
- the concentration of phosphoric acid is not more than, with increasing preference in the order given, 0.55, 0.50, or 0.45 mol/L.

A completely nonsludging zinc phosphate treatment can be carried out by immersing the metal workpiece in a zinc phosphate treatment bath as described above and passing electric current in a cathodizing direction through the workpiece. In regards to the conditions during electrolysis, the amount of applied electricity (current×time) should be adjusted in correspondence to the required coating weight, but the use of a current density that is at least, with increasing preference in the order given, 0.5, 1.0, 2.0, 3.0, 4.0, 5.0, 6.0, 7.0, 8.0, 9.0, or 9.5 amps per square decimeter (this unit of current density being hereinafter usually abbreviated as "$A/dm^2$") and independently preferably is not more than, with increasing preference in the order given, 50, 40, 30, 25, 20, 15, or 11 $A/dm^2$, is preferred in order to obtain a high quality coating in a relatively short time. While the temperature of the zinc phosphate treatment bath can be in the broad range from 30 to 90° C., preferably the temperature is at least, with increasing preference in the order given, 50, 60, 65, 70, 75, or 78° C. and independently preferably is not more than 85° C., based on such considerations as the conductivity of the treatment bath and efficiency of coating formation.

With the objectives of microfine-sizing the coating crystals and achieving high coating-formation rates during electrolysis, two methods for improving the coating formation performance, without raising the zinc concentration, have been discovered. One of these methods consists of the use of an additive in the metal working lubricant. In more specific terms, one or more selections from the following is preferably present in a zinc phosphate treatment bath of this invention: nitrous acid, permanganic acid, peroxysulfuric acid, hydrogen peroxide, chloric acid, perchloric acid, nitrobenzene sulfonic acid, hydroxylamine, starch/phosphoric acid esters, fluorine compounds, and salts of all the chemical substances previously recited in this sentence when salts of such substances are known. Acids among these additives may be added directly as the acid or as an alkali metal or ammonium salt of the acid. Hydroxylamine is in general preferably added as its salt with, for example, sulfuric acid. Usable as the fluorine compounds are hydrofluoric acid, hexafluorosilicic acid, hexafluorotitanic acid, hexafluorozirconic acid, and the like; these are preferably added as the acid or an alkali metal or ammonium salt. The additive concentration should be selected as appropriate for the desired coating formation rate, but in general is preferably in the range from 0.0005 to 0.1 mol/L.

A second method for increasing the coating formation performance comprises contacting the metal workpiece—prior to the execution thereon of the zinc phosphate treatment by cathodic electrolysis with a weakly basic aqueous colloidal solution that contains titanium oxide, titanium hydroxide, and zinc phosphate. The colloidal particles therein are believed to adsorb on the surface of the metal workpiece and function as nuclei for the crystals during ensuing formation of the zinc phosphate coating. The inclusion of this step not only serves to improve the efficiency of formation of the zinc phosphate coating that is produced by cathodic electrolysis, but also promotes extremely fine crystal grain size in the coating. More preferably, both of these first and second methods for improving the coating formation performance without increasing the zinc concentration are included in a process according to the invention.

This invention may be further appreciated in specific detail by consideration of the following working and comparative examples, but the invention is not limited to or by the working examples.

Example 1

Zinc carbonate ($ZnCO_3$) was added to a mixed aqueous solution of phosphoric acid and nitric acid in which the phosphoric acid concentration was 0.40 mol/L and the nitric acid concentration was 0.80 mol/L, the amount of zinc carbonate added producing a zinc concentration of 0.50 mol/L in the resulting solution. When the resulting aqueous solution was heated to 80° C. and held at this temperature for 2 hours, absolutely no turbidity was observed in the solution and a transparent appearance was maintained from beginning to end. The zinc concentration in this aqueous solution was lower than the zinc concentration limit of 0.52 mol/L calculated using mathematical condition (6).

Comparative Example 1

Zinc carbonate ($ZnCO_3$) was added to a mixed aqueous solution of phosphoric acid and nitric acid in which the phosphoric acid concentration was 0.40 mol/L and the nitric acid concentration was 0.70 mol/L, the amount of zinc carbonate added producing a zinc concentration of 0.50 mol/L in the resulting solution. When the resulting aqueous solution was heated to 80° C. and held at this temperature for 2 hours, the gradual development of turbidity was observed and a white precipitate was ultimately produced. The zinc concentration in this aqueous solution was higher than the zinc concentration limit of 0.47 mol/L calculated using mathematical condition (6). The white precipitate was filtered off, washed, and dried. X-ray diffraction analysis of the resulting powder identified it as zinc phosphate.

Example 2

Zinc carbonate ($ZnCO_3$) was added to a mixed aqueous solution of phosphoric acid and nitric acid in which the phosphoric acid concentration was 0.60 mol/L and the nitric acid concentration was 1.0 mol/L, the amount of zinc carbonate added producing a zinc concentration of 0.65 mol/L in the resulting solution. When the resulting aqueous solution was heated to 80° C. and held at this temperature for 2 hours, absolutely no turbidity was observed in the solution and a transparent appearance was maintained from beginning to end. The zinc concentration in this aqueous solution was lower than the zinc concentration limit of 0.68 mol/L calculated using mathematical condition (6).

Comparative Example 2

Zinc carbonate ($ZnCO_3$) was added to a mixed aqueous solution of phosphoric acid and nitric acid in which the phosphoric acid concentration was 0.60 mol/L and the nitric acid concentration was 0.90 mol/L, the amount of zinc carbonate added producing a zinc concentration of 0.65 mol/L in the resulting solution. When the resulting aqueous solution was heated to 80° C. and held at this temperature for 2 hours, the gradual development of turbidity was observed and a white precipitate was ultimately produced. The zinc concentration in this aqueous solution was higher than the zinc concentration limit of 0.63 mol/L calculated using mathematical condition (6).

Example 3

Zinc carbonate ($ZnCO_3$) was added to a mixed aqueous solution of phosphoric acid and nitric acid in which the phosphoric acid concentration was 0.20 mol/L and the nitric acid concentration was 0.40 mol/L, the amount of zinc carbonate added producing a zinc concentration of 0.25 mol/L in the resulting solution. When the resulting aqueous solution was heated to 80° C. and held at this temperature for 2 hours, absolutely no turbidity was observed in the solution and a transparent appearance was maintained from beginning to end. The zinc concentration in this aqueous solution was lower than the zinc concentration limit of 0.26 mol/L calculated using mathematical condition (6).

Comparative Example 3

Zinc carbonate ($ZnCO_3$) was added to a mixed aqueous solution of phosphoric acid and nitric acid in which the phosphoric acid concentration was 0.20 mol/L and the nitric acid concentration was 0.40 mol/L, the amount of zinc carbonate added producing a zinc concentration of 0.30 mol/L in the resulting solution. When the resulting aqueous solution was heated to 80° C. and held at this temperature for 2 hours, the gradual development of turbidity was observed and a white precipitate was ultimately produced. The zinc concentration in this aqueous solution was higher than the zinc concentration limit of 0.26 mol/L calculated using mathematical condition (6).

Example 4

Hot-rolled steel according to Japanese Industrial Standard (hereinafter usually abbreviated as "JIS") S45C was degreased and then dipped for 30 seconds in 5% HCl solution in water at ambient temperature to prepare a test panel whose surface was freed of its oxide film. This test panel was then dipped in the aqueous solution of Example 1, which had been heated to 80° C., and subjected to cathodic electrolysis at a current density of 10 A/dm$^2$. A zinc phosphate coating was thereby formed on the surface of the test panel. Investigation of the electrolysis time that produced a 50% surface coverage ratio by the zinc phosphate coating gave a value of 10 seconds. The coverage ratio was determined by scanning electron microscope (hereinafter usually abbreviated as "SEM") observation at 500×. At this time point the crystal size in the zinc phosphate coating was a maximum of approximately 50 micrometres (hereinafter usually abbreviated as "μm"). Zinc phosphate treatment was also carried out by electrolysis under the same conditions (current density=10 A/dm$^2$, electrolysis time=10 seconds) with the addition of 0.001 mol/L of sodium nitrite ($NaNO_2$) to the Example 1 aqueous solution. SEM observation showed that the coverage ratio by the coating had improved to approximately 90%. In this case the crystal size in the zinc phosphate coating was a maximum of approximately 40 μm.

Example 5

Zinc phosphate treatment was carried out by electrolysis under the same conditions as in Example 4 (current density=10 A/dm$^2$, electrolysis time=10 seconds), except with the addition of 0.007 mol/L of sodium fluoride (NaF) and 0.04 mol/L of hexa-fluorosilicic acid ($H_2SiF_6$) to the Example 1 aqueous solution. SEM observation showed that the coverage ratio by the coating was 100%. At this point the crystal size in the zinc phosphate coating was a maximum of approximately 30 μm.

Example 6

Zinc phosphate treatment was carried out by electrolysis under the same conditions as in Example 4 (current density=10 A/dm$^2$, electrolysis time=10 seconds), except with the addition of 0.001 mol/L of potassium permanganate ($KMnO_4$) to the Example 1 aqueous solution. SEM observation showed that the coverage ratio by the coating was 100%. At this point the crystal size in the zinc phosphate coating was a maximum of approximately 60 μm.

Example 7

Zinc phosphate treatment was carried out by electrolysis under the same conditions as in Example 4 (current density=10 A/dm$^2$, electrolysis time=10 seconds), except with the addition of 0.01 mol/L of sodium persulfate ($Na_2S_2O_8$) to the Example 1 aqueous solution. SEM observation showed that the coverage ratio by the coating was 100%. At this point the crystal size in the zinc phosphate coating was a maximum of approximately 30 μm.

Example 8

Zinc phosphate treatment was carried out by electrolysis under the same conditions as in Example 4 (current density=10 A/dm$^2$, electrolysis time=10 seconds), except with the addition of 0.005 mol/L of sodium meta-nitrobenzenesulfonate ($C_6H_4NO_2SO_3Na$) to the Example 1 aqueous solution. SEM observation showed that the coverage ratio by the coating was 100%. At this point the crystal size in the zinc phosphate coating was a maximum of approximately 40 μm.

Example 9

Zinc phosphate treatment was carried out by electrolysis under the same conditions as in Example 4 (current density=10 A/dm$^2$, electrolysis time=10 seconds), except with the addition of 0.01 mol/L of hydroxylamine sulfate (i.e., $(NH_2OH)_2.H_2SO_4$) to the Example 1 aqueous solution. SEM observation showed that the coverage ratio by the coating was 85%. At this point the crystal size in the zinc phosphate coating was a maximum of approximately 60 μm.

Example 10

Zinc phosphate treatment was carried out by electrolysis under the same conditions as in Example 4 (current density=10 A/dm$^2$, electrolysis time=10 seconds), except with the addition of 2 grams of sodium starch phosphate ester per liter of solution to the Example 1 aqueous solution. (The concentration unit of grams of a specified ingredient per liter of solution is hereinafter usually abbreviated as "g/L".) SEM observation showed that the coverage ratio by the coating was 100%. At this point the crystal size in the zinc phosphate coating was a maximum of approximately 60 μm.

Example 11

A JIS S45C test panel was first degreased and acid rinsed and was thereafter dipped for 30 seconds at ambient temperature in a 3 g/L aqueous solution of PREPALENE® Z (colloidal titanium solution), a surface conditioner commercially available from Nihon Parkerizing Co., Ltd. The test panel was then immediately subjected to zinc phosphate treatment by electrolysis under the same conditions as in Example 4 (current density=10 A/dm$^2$, electrolysis time=10 seconds) using the aqueous solution described for Example 1. SEM observation showed that the coverage ratio by the coating was 100%. At this point the crystal size in the zinc phosphate coating was a maximum of approximately 15 μm.

The treatment bath remained transparent from beginning to end in each of the cathodic electrolysis steps in Examples 4 to 11, and in each case the production of a precipitate was also entirely absent.

Examples 1 to 3 demonstrate that no precipitation of zinc phosphate occurred even when a zinc phosphate treatment bath of this invention, i.e., a bath containing a zinc concentration less than or equal to the zinc concentration limit defined by mathematical condition (6), was heated to 80° C. In contrast to this, as shown in Comparative Examples 1 to 3, precipitation of zinc phosphate did occur in the case of zinc phosphate treatment baths containing a zinc concentration in excess of the zinc concentration limit defined by mathematical condition (6).

As demonstrated by Examples 4 to 10, the use of additive-containing zinc phosphate treatment baths according to this invention enabled the formation of zinc phosphate coatings at excellent coverage ratios even in relatively short electrolysis time, e.g., 10 seconds.

Finally, as demonstrated by Example 11, application of the colloidal titanium surface conditioning treatment of this invention prior to the electrolytic zinc phosphate treatment not only resulted in the formation of a coating with a perfect coverage ratio, but also supported the formation of a coating that contained extremely fine and dense zinc phosphate crystals.

Use of the zinc phosphate treatment bath of this invention completely eliminates the production of industrial waste (sludge) that has plagued the prior art and in this manner makes a substantial contribution to reducing global environmental pollution. The process of this invention enables zinc phosphate treatment to be run very rapidly through the use of electrolysis. This feature, in combination with the fact that this process can be used to execute zinc phosphate treatment on essentially any material that is electrically conductive, makes the instant process highly advantageous on an industrial or commercial basis.

What is claimed is:

1. A nonsludging composition, comprising:

water;

zinc ions (Zn);

phosphate ions ($H_3PO_4$);

nitrate ions ($HNO_3$); and m cations other than zinc and n anions other than phosphate and nitrate, wherein each of m and n independently are zero or a positive integer, and the concentration of zinc in said composition satisfies the following mathematical conditions:

$$\{Zn\} \le 0.3\{H_3PO_4\} + 0.5\{HNO_3\} - 0.5\sum_{i=0}^{m} p_i C_i + 0.5\sum_{j=0}^{n} q_j A_j; \text{ and}$$

$$\{Zn\} \ge 0.27\{H_3PO_4\} + 0.45\{HNO_3\} - 0.45\sum_{i=0}^{m} p_i C_i + 0.45\sum_{j=0}^{n} q_j A_j.$$

wherein:

all concentrations are in mol/L;

$A_0$ and $C_0$ are 0;

$p_i$ is the valence of cations other than zinc; and $q_j$ is the valence of anions other than phosphate and nitrate.

2. A liquid composition according to claim 1, additionally comprising 0.0005 to 1.0 mol/L of at least one additive selected from the group consisting of nitrous acid, permanganic acid, peroxysulfuric acid, hydrogen peroxide, chloric acid, perchloric acid, nitrobenzene sulfonic acid, hydroxylamine, starch/phosphoric acid esters, fluorine compounds, and salts of all the other materials previously recited in this group for which salts are known.

3. The liquid composition of claim 1, wherein:

the phosphoric acid concentration is from 0.20 to 0.60 mol/L;

the nitric acid concentration is from 0.30 to 1.0 mol/L.

4. The liquid composition of claim 1, wherein:

the phosphoric acid concentration is from 0.30 to 0.50 mol/L.

5. A nonsludging composition, comprising:

water;

zinc ions (Zn);

phosphate ions ($H_3PO_4$), wherein the phosphoric acid concentration is from 0.30 to 0.50 mol/L;

nitrate ions ($HNO_3$); and m cations other than zinc and n anions other than phosphate and nitrate, wherein each of m and n independently are zero or a positive integer, and the concentration of zinc in said composition satisfies the following mathematical conditions:

$$\{Zn\} \le 0.3\{H_3PO_4\} + 0.5\{HNO_3\} - 0.5\sum_{i=0}^{m} p_i C_i + 0.5\sum_{j=0}^{n} q_j A_j; \text{ and}$$

$$\{Zn\} \ge 0.27\{H_3PO_4\} + 0.45\{HNO_3\} - 0.45\sum_{i=0}^{m} p_i C_i + 0.45\sum_{j=0}^{n} q_j A_j.$$

wherein:

all concentrations are in mol/L;

$A_0$ and $C_0$ are 0;

$p_i$ is the valence of cations other than zinc; and $q_j$ is the valence of anions other than phosphate and nitrate.

6. A liquid composition of matter that is suitable as electrolyte for a nonsludging electrolytic zinc phosphate treatment process, said liquid composition comprising water, dissolved phosphoric acid, dissolved nitric acid, dissolved zinc cations, m chemically distinct species of cations other than zinc, and n distinct species of anions other than anions derivable by ionization of phosphoric and nitric chemically acids, each of m and n independently being zero or a positive integer, the concentration of zinc in moles per liter in said liquid composition satisfying the following mathematical condition:

$$\{Zn\} \le 0.3\{H_3PO_4\} + 0.5\{HNO_3\} - 0.5\sum_{i=0}^{m} p_i C_i + 0.5\sum_{j=0}^{n} q_j A_j$$

in which: "{Zn}", "{$H_3PO_4$}", and "{$HNO_3$}" respectively represent the zinc, phosphoric acid, and nitric acid concentrations in mol/L; each of $C_0$ and $A_0$ is zero; each of $p_0$ and $q_0$ is 1; if m is not zero, for each positive integer i from 1 to m, $C_i$ represents the concentration in mol/L of the i'th distinct cation species other than zinc present in the bath and $p_i$ represents the cationic valence of said i'th distinct cation species; and if n is not zero, for each positive integer j from 1 to n, $A_y$ represents the concentration in mol/L of the j'th distinct anion species other than anions derivable by ionization of phosphoric or nitric acids present in the bath and $q_j$ represents the anionic valence of said j'th distinct anion species;

the phosphoric acid concentration is from 0.25 to 0.50 mol/L;

the nitric acid concentration is from 0.65 to 0.90 mol/L; and $$\{Zn\} \ge 0.27\{H_3PO_4\} + 0.45\{HNO_3\} - 0.45\sum_{i=0}^{m} p_i C_i + 0.45\sum_{j=0}^{n} q_j A_j.$$

7. A liquid composition according to claim 6, wherein {Zn}/{H3PO4}<0.91.

8. A liquid composition according to claim 6, additionally comprising at least one additive selected from the group consisting of nitrous acid, permanganic acid, peroxysulfuric acid, hydrogen peroxide, chloric acid, perchloric acid, nitrobenzene sulfonic acid, hydroxylamine, starch/phosphoric acid esters, fluorine compounds, and salts of all of the other materials previously recited in this group for which salts are known.

9. A liquid composition according to claim 6, additionally comprising 0.0005 to 1.0 mol/L of at least one additive selected from the group consisting of nitrous acid, permanganic acid, peroxysulfuric acid, hydrogen peroxide, chloric acid, perchloric acid, nitrobenzene sulfonic acid, hydroxylamine, starch/phosphoric acid esters, fluorine compounds, and salts of all the other materials previously recited in this group for which salts are known.

10. A process for forming a zinc phosphate conversion coating on a metal substrate without generating any sludge thereby, said process comprising operations of:

(I) bringing said metal substrate into contact with a volume of a liquid composition according to claim 1, said volume of liquid composition also being in contact with a counter electrode that is distinct from said metal substrate; and (II) causing electric current to flow in a cathodizing direction through said metal substrate into said volume of liquid composition and through said counter electrode.

11. A process according to claim 10, wherein:

said volume of liquid composition is maintained during operation (II) at a temperature that is between 50 and 85° C.; and in operation (II) there is a current density through said metal substrate that is between 0.5 and 50 A/dm$^2$.

12. A process according to claim 10, wherein prior to operation (I), said metal substrate is brought into contact with a weakly basic aqueous colloidal solution that contains titanium oxide, titanium hydroxide, and zinc phosphate.

13. A process for forming a zinc phosphate conversion coating on a metal substrate without generating any sludge thereby, said process comprising operations of:

(I) bringing said metal substrate into contact with a volume of a liquid composition according to claim 5, said volume of liquid composition also being in contact with a counter electrode that is distinct from said metal substrate; and (II) causing electric current to flow in a cathodizing direction through said metal substrate into said volume of liquid composition and through said counter electrode.

14. A process according to claim 13, wherein:

said volume of liquid composition is maintained during operation (II) at a temperature that is between 75 and 85° C.; and in operation (II) there is a current density through said metal substrate that is between 7.0 and 15 A/dm$^2$.

15. A process according to claim 13, wherein prior to operation (I), said metal substrate is brought into contact with a weakly basic aqueous colloidal solution that contains titanium oxide, titanium hydroxide, and zinc phosphate.

16. A process for forming a zinc phosphate conversion coating on a metal substrate without generating any sludge thereby, said process comprising operations of:

(I) bringing said metal substrate into contact with a volume of a liquid composition according to claim 6, said volume of liquid composition also being in contact with a counter electrode that is distinct from said metal substrate; and (II) causing electric current in flow in a cathodizing direction through said metal substrate into said volume of liquid composition and through said counter electrode.

17. A process according to claim 16, wherein:

said volume of liquid composition is maintained during operation (II) at a temperature that is between 50 and 85° C.; and in operation (II) there is a current density through said metal substrate that is between 0.5 and 50 A/dm$^2$.

18. A process according to claim 17, wherein:

said volume of liquid composition is maintained during operation (II) at a temperature that is between 75 and 85° C.; and in operation (II) there is a current density through said metal substrate that is between 7.0 and 15 A/dm$^2$.

19. A process according to claim 16, wherein prior to operation (I), said metal substrate is brought into contact with a weakly basic aqueous colloidal solution that contains titanium oxide, titanium hydroxide, and zinc phosphate.

* * * * *